US012540511B1

(12) United States Patent
Downton

(10) Patent No.: US 12,540,511 B1
(45) Date of Patent: Feb. 3, 2026

(54) ROLL ISOLATED ROTARY STEERABLE SYSTEMS EMPLOYING DIGITAL VALVES

(71) Applicant: Schlumberger Technology Corporation, Sugar Land, TX (US)

(72) Inventor: Geoffrey Charles Downton, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/218,809

(22) Filed: May 27, 2025

(51) Int. Cl.
*E21B 7/06* (2006.01)
*E21B 7/04* (2006.01)

(52) U.S. Cl.
CPC ..... *E21B 7/067* (2013.01); *E21B 7/04* (2013.01)

(58) Field of Classification Search
CPC ..... E21B 7/04; E21B 7/067
See application file for complete search history.

(56) References Cited

U.S. PATENT DOCUMENTS 10,837,234 B2 11/2020 Marshall
2012/0160565 A1* 6/2012 Downton ..... E21B 7/062 175/73

* cited by examiner

*Primary Examiner* — Tara Schimpf
*Assistant Examiner* — Lamia Quaim
(74) *Attorney, Agent, or Firm* — Jeffrey D. Frantz

(57) ABSTRACT

A rotary steerable system including a plurality of extendable pads deployed in a drill collar. Each of the pads is configured to extend radially outward from the drill collar and engage a wellbore wall and steer a direction of drilling. A plurality of digital valves is in fluid communication with corresponding ones of the plurality of extendable pads such that opening one of the plurality of digital valves provides high pressure drilling fluid to the corresponding pad thereby radially extending the pad. An electronic control unit deployed in a roll-isolated housing is configured to independently open and close each of the plurality of digital valves via a communications signal.

11 Claims, 4 Drawing Sheets

ROLL ISOLATED ROTARY STEERABLE SYSTEMS EMPLOYING DIGITAL VALVES

BACKGROUND

The use of rotary steerable systems is well known in downhole drilling operations. Rotary steerable systems are known, for example, to improve the rate of penetration of drilling, provide improved hole cleaning owing to the continuous rotation of the drill string, and to provide more accurate well placement at a reduced overall cost as compared to mud motor/bent sub technology.

Numerous commercially available rotary steerable systems make use of hydraulically actuated pads (or blades) to steer. In such systems, the pads may be extended outward from the tool body or retracted inward towards the tool body to actuate and/or adjust the direction of drilling. While such rotary steerable systems are suitable in a wide range of drilling operations, there is room for further improvement. For example, in recent years there has been a trend towards increasing the functionality of rotary steerable systems to provide high quality survey results and to make certain logging while drilling measurements. There is a need for a rotary steerable system with improved versatility to accommodate such increased functionality.

BRIEF DESCRIPTION OF THE DRAWINGS

For a more complete understanding of the disclosed subject matter, and advantages thereof, reference is now made to the following descriptions taken in conjunction with the accompanying drawings, in which.

SUMMARY

Rotary steerable systems are disclosed comprising a drill collar, a plurality of extendable pads deployed in and circumferentially about the drill collar with each of the pads being configured to extend radially outward from the drill collar and engage a wellbore wall and steer a direction of drilling. The system further includes a plurality of digital valves, each which is in fluid communication with a corresponding one of the plurality of extendable pads such that opening one of the plurality of digital valves provides high pressure drilling fluid to the corresponding pad thereby radially extending the pad. Closing the valve disconnects the pad from the pressurized drilling fluid thereby enabling the pad to retract. The system further includes a roll-isolated housing and an electronic control unit deployed therein. The electronic control unit includes a plurality of electronic sensors and a processing unit configured to independently open and close each of the plurality of digital valves via a communications signal.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Rotary steerable systems are disclosed. A plurality of extendable pads are deployed in and circumferentially about a drill collar with each of the pads being configured to extend radially outward from the drill collar and engage a wellbore wall and steer a direction of drilling. A plurality of digital valves is in fluid communication with corresponding ones of the plurality of extendable pads such that opening one of the plurality of digital valves provides high pressure drilling fluid to the corresponding pad thereby radially extending the pad. An electronic control unit deployed in a roll-isolated housing is configured to independently open and close each of the plurality of digital valves via a communications signal. In example embodiments, the digital valves are also deployed in the roll-isolated housing and are configured to connect and disconnect the corresponding extendable pads from high pressure drilling fluid through a rotary coupling deployed between the roll-isolated housing and the drill collar.

Figure 1:
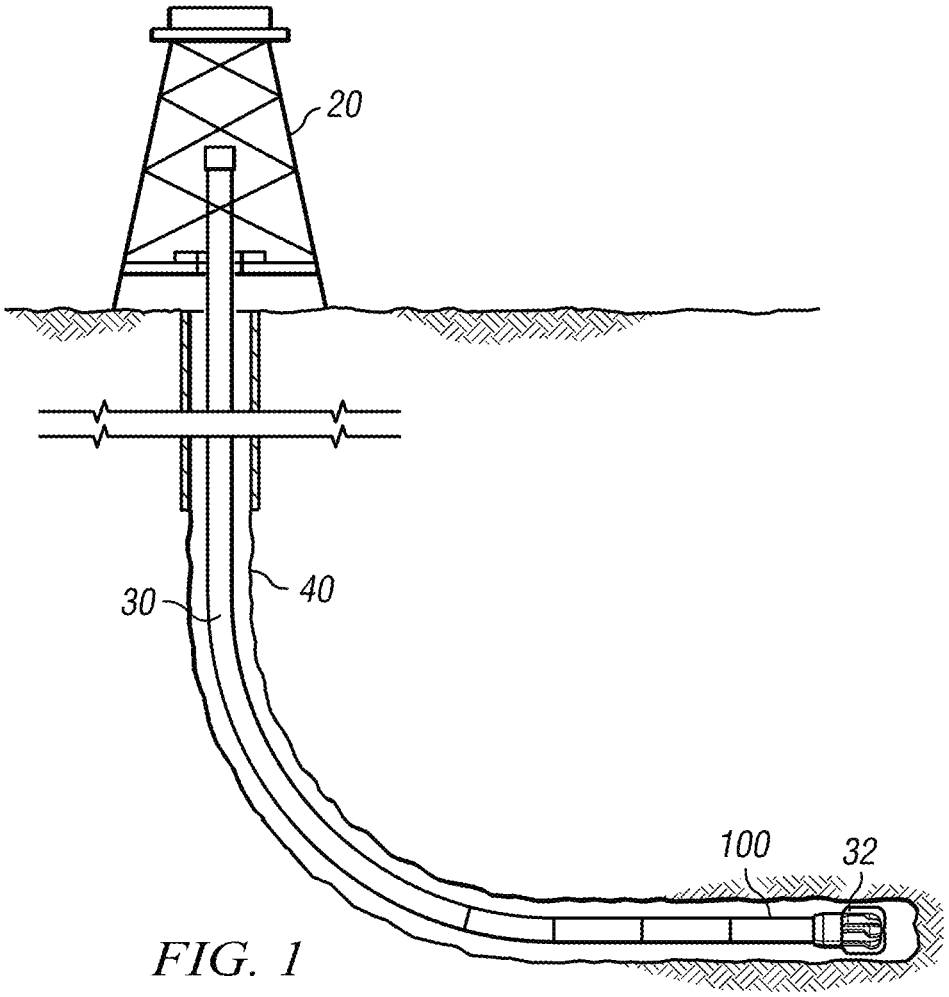
FIG. 1 depicts a prior art drilling rig including a disclosed rotary steerable tool.

FIG. 1 depicts a drilling rig 20 including a drill string 30 disposed within a wellbore 40. The drill string includes a rotary steerable system (RSS) 100 deployed in the string 30, e.g., just above (uphole from) a drill bit 32. The drilling rig 20 may be deployed onshore or offshore (an onshore application is depicted). As is known to those of ordinary skill, offshore rigs commonly include a platform deployed atop a riser that extends from the sea floor to the surface. The drill string extends downward from the platform, through the riser, and into the wellbore through a blowout preventer (BOP) located on the sea floor. The disclosed embodiments are not limited in these regards. In both onshore and offshore operations, the wellbore 40 may be drilled in the subterranean formations via rotary drilling techniques that are well-known to those of ordinary skill in the art.

In the illustrated embodiment, RSS 100 may be deployed in a bottom hole assembly (BHA) including other downhole tools. The BHA may further include, for example, drill bit 32, a mud motor, a measurement while drilling (MWD) tool, and one or more logging while drilling (LWD) tools. As is known to those of ordinary skill, an MWD tool may be configured to measure characteristics of the wellbore as it is drilled or at any time thereafter. The wellbore characteristics may include, for example, pressure, temperature, wellbore caliper, wellbore trajectory (inclination and azimuth), a toolface angle, and the like. An MWD tool may be further configured to communicate with the surface (e.g., using an electromagnetic or mud pulse/siren telemetry tool). As is also known to those of ordinary skill, LWD tools may be configured to measure various properties of the formation through which the wellbore penetrates, for example, including resistivity, NMR relaxation times, density, porosity, sonic velocity, gamma ray counts, and the like. The disclosed RSS 100 may also be configured to measure formation properties and/or wellbore properties. It will, of course, be understood that the disclosed embodiments are not limited to any particular BHA configuration.

Figure 2:
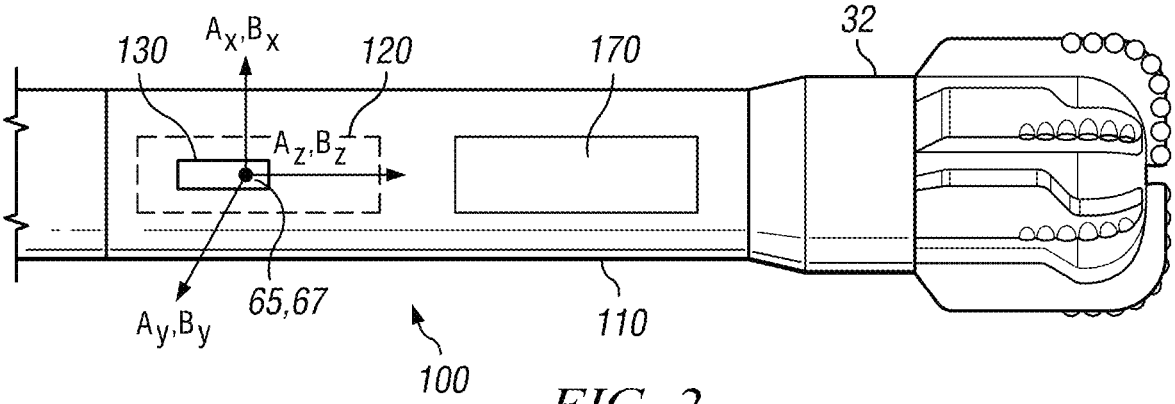
FIG. 2 depicts the lower BHA portion of the drill string in FIG. 1

FIG. 2 depicts the lower BHA portion of drill string 30 including drill bit 32 and RSS 100. In the depicted example embodiment, RSS 100 includes a plurality of pads 170 deployed in and configured to be extended outward from a rotating tool (drill) collar 110. In example embodiments, RSS 100 may include three circumferentially spaced pads 170 deployed at approximately 120 degree intervals about the collar. The pads may be extended independently into contact with the wellbore wall so as to push or point the drill bit 32 in a desired direction (towards a desired toolface angle) and thereby actuate steering. While FIG. 2 depicts a "push the bit" configuration, it will be readily appreciated that the disclosed embodiments may also be utilized in "point the bit" configurations. The disclosed embodiments are expressly not limited in these regards.

As further depicted in the example embodiment shown on FIG. 2, RSS 100 may further include navigation (survey) sensors 65, 67 deployed in a control unit 130 in a roll-isolated sensor housing 120 (such as a roll-stabilized housing). These sensors 65, 67 may include, for example, tri-axial accelerometer 65 and tri-axial magnetometer 67 sensor sets. The navigation sensors may include substantially any suitable commercially available devices, for example, including conventional Q-flex type accelerometers or micro-electro-mechanical systems (MEMS) solid-state accelerometers, ring core flux gate magnetometers or magnetoresistive sensors, and MEMS type gyros.

FIG. 2 further depicts a diagrammatic representation of the navigation sensors 65, 67. By tri-axial it is meant that accelerometer and magnetometer sensor sets each include three mutually perpendicular sensors, the accelerometers being designated as $A_x$, $A_y$, and $A_z$ and the magnetometers being designated as $B_x$, $B_y$, and $B_z$. By convention, a right handed system may be designated in which the z-axis accelerometer and magnetometer ($A_z$ and $B_z$) are oriented substantially parallel with the tool axis (and therefore the wellbore axis) as indicated (although disclosed embodiments are not limited by such conventions). Of course, the disclosed embodiments are not limited to those including only accelerometers and magnetometers. Other sensors may also be deployed in the housing 120, for example, including one, two, or three axis gyroscopic sensors, natural gamma ray sensors, temperature sensors, pressure sensors, and the like. The control unit 130 may also include additional accelerometers and magnetometers for purposes other than surveying the wellbore.

As noted above, RSS 100 includes a control unit 130 deployed in a roll-isolated housing 120. By roll-isolated it is meant that the housing 120 is not rotationally coupled with the collar 110 (or not fully or rigidly rotationally coupled with the collar). As described in more detail below, the housing 120 may rotate completely independently from the drill string 30 and collar 110 in some embodiments and in other embodiments may rotate independently from the collar 110 at high frequencies (or high torsional accelerations) while rotating with the collar 110 at low frequencies (or low torsional accelerations). In some embodiments, the rotation of the housing 120 may be controlled such that it is substantially non-rotating with respect to the wellbore (or may rotate very slowly in comparison to the drill string). For example, various PowerDrive rotary steerable systems include a drill collar that is intended to fully rotate with the drill string and an internal roll-stabilized control unit that is intended (at certain times) to remain substantially rotationally geostationary (i.e., rotationally stable with respect to the tool axis, the tool axis attitude being defined with respect to the wellbore reference frame).

Figure 3A:
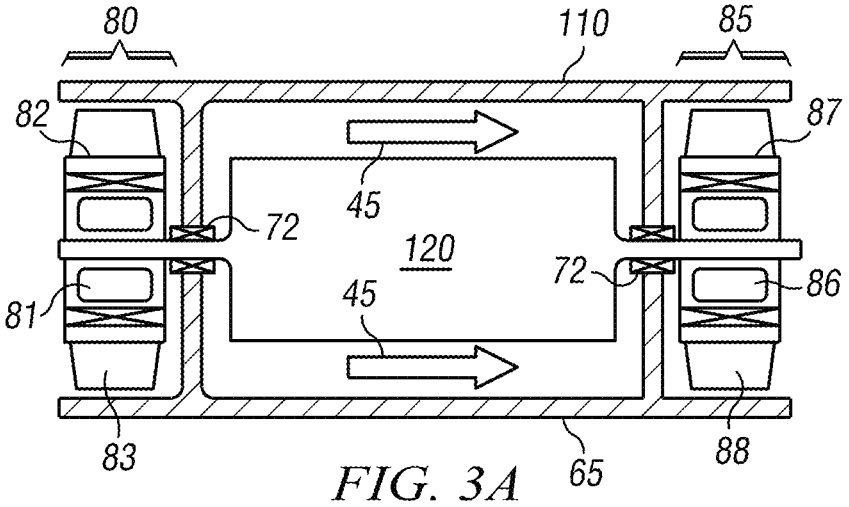
FIGS. 3A and 3B (collectively FIG. 3) depict a schematic representation of one example roll-stabilized housing embodiment.
Figure 3B:
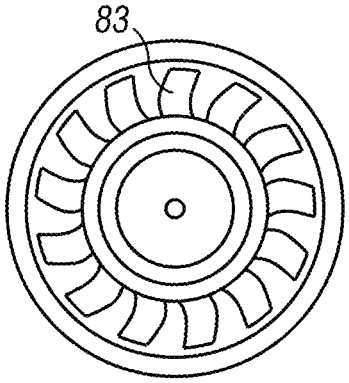

FIGS. 3A and 3B (collectively FIG. 3) depict a schematic representation of one example of a roll-stabilized housing 120 deployed in a rotary steerable tool 100 (FIG. 2). It will be understood that this is merely an example and that the disclosed RSS embodiments are not limited to any particular roll-stabilizing mechanism or configuration. In the depicted example schematic, the roll-stabilized housing 120 may be mounted on bearings 72 such that it is rotationally decoupled from (able to rotate independently with respect to) the collar 110. In the depicted example embodiment, first and second alternators 80, 85 (e.g., of the permanent magnet synchronous motor type) may be separately mounted on opposing axial ends of the roll-stabilized housing 120. The corresponding stator windings 81, 86 may be mechanically continuous with the roll-stabilized housing 120 (and may therefore be rotationally coupled with the roll-stabilized housing). Corresponding rotors including permanent magnets 82, 87 are configured to rotate independently of both the roll-stabilized housing 120 and the collar 110. Impeller blades 83, 88 are mechanically contiguous with the corresponding rotors and span the annular clearance between the housing 120 and the collar 110 such that they rotate, for example, in opposite directions with the flow 45 of drilling fluid through the system.

In the depicted example, the rotational orientation of the housing 120 may be controlled by the co-action of the alternators 80, 85 in combination with feedback provided by the sensors (e.g., the accelerometers and/or magnetometers) deployed in the housing. The impellers 83, 88 being configured to rotate in opposite directions apply corresponding opposite torques to the housing 120. The amount of electrical load on the torque generators 80, 85 may be changed in response to feedback from the at least one of the sensors 65, 67 (FIG. 2) to vary the applied torques and thereby control the orientation of the housing.

In conventional rotary steerable systems, the control unit may have an output shaft that is rigidly connected (rotationally coupled) to a rotary valve. The rotary valve directs fluid from the flowing drilling fluid to a pad (or an actuator in a steering bias unit), which then acts to steer the tool (e.g., by acting on the borehole wall or by acting on a bit shaft). Thus by controlling the orientation of the control unit, the orientation of the rotary valve may be controlled, thereby providing steering control. It will be appreciated that the disclosed embodiments advantageously do not require the use of such a rotary valve.

Referring again to FIG. 2, RSS 100 further includes a plurality of digital valves (e.g., solenoid valves or bistable valves) in fluid communication with corresponding ones of the pads 170. It will be appreciated that the digital valves are not depicted on FIG. 2. Deployment of the digital valves in the RSS is described in more detail below with respect to FIGS. 4-6. The digital valves and corresponding pads are configured such that the pads may be independently actuated (e.g., one at a time, any two at a time, or all three at a time in embodiments including three pads). For example, actuation of a first digital valve may be operative to actuate (extend) a corresponding first pad, actuation of a second digital valve may be operative to actuate (extend) a corresponding second pad, and so on. In example embodiments, opening the digital valve provides high pressure drilling fluid to the corresponding pad thereby rapidly extending the pad (e.g., into contact with the wellbore wall). Closing the valve disconnects the pad from the pressurized drilling fluid and enables the pad to retract (e.g., via contact with the wellbore wall and venting of the fluid into the annulus or via a spring bias). In some example embodiments, a single digital valve may be utilized to actuate two pads as the digital valve has two positions. For example, in a first position the digital valve may connect a first pad pressurized drilling fluid and disconnect a second pad from the pressurized drilling fluid and in a second position the digital valve may connect the second pad to pressurized drilling fluid and disconnect the first pad from the pressurized drilling fluid.

In advantageous embodiments, the digital valves may include bistable valves (rather than solenoid valves) that are configured to have two stable positions (e.g., a stable open position and a stable closed position). In such embodiments, once the bistable valve is actuated to move into either of the two stable positions, no additional energy is required to maintain the valve in that position. For example, the bistable valve may be in a first position (e.g., the closed valve position), such that drilling fluid is prevented from flowing through the valve to the steering pad. As stated above, the bistable valve will not require any additional energy to remain in the first position (closed). When the bistable valve is in the second position (open), pressurized drilling fluid is directed to the pad. As with the first position, the bistable valve will not require any additional energy to remain in the second position (open). The bistable valve may be advantageously configured to change from the first position to the second position or from the second position to the first position when a communication signal is received (such as an electronic or magnetic communication signal).

While not depicted on FIG. 2, it will be appreciated that the digital valves may be deployed either in and rotationally coupled with the collar 110 or in and rotationally coupled with the roll-isolated housing 120. In embodiments in which the digital valves are deployed on the collar 110, an electrical or electronic connection is required between the housing 120 and the digital valves (e.g., to actuate the digital valves). As described in more detail below with respect to FIGS. 4 and 5, in example RSS embodiments the electrical or electronic connection may include a hardwire connection or a slip ring connection. In embodiments in which the digital valves are deployed in the roll-isolated housing 120, fluid communication is required between the digital valves in the housing 120 and the corresponding pads 170 that are located in the collar 110. As described in more detail below with respect to FIG. 6, such fluid communication may be provided through the use of a rotary coupling (such as a rotary friction coupling) deployed between the housing 120 and the collar 110.

The disclosed RSS embodiments may advantageously isolate sensitive electronics from torsional vibration thereby providing higher measurement quality while at the same time providing freedom to actuate the pads (via the digital valves) as desired or needed given the operational constraints of the drilling job. Moreover, decoupling the rotational orientation of the control unit from pad actuation may advantageously provide improved versatility in that the rotational orientation of the control unit may be selected based on other constraints. For example, in certain embodiments in which the roll-isolated housing includes an azimuthal gamma ray sensor, the roll-isolated housing may be rotated at the optimum speed for making azimuthal gamma measurements without influencing wellbore steering. Moreover, having the ability to rotate the control unit sensors to any angle without disturbing the wellbore steering direction may enable certain sensor calibrations can be performed to improve measurement accuracy.

Figure 4:
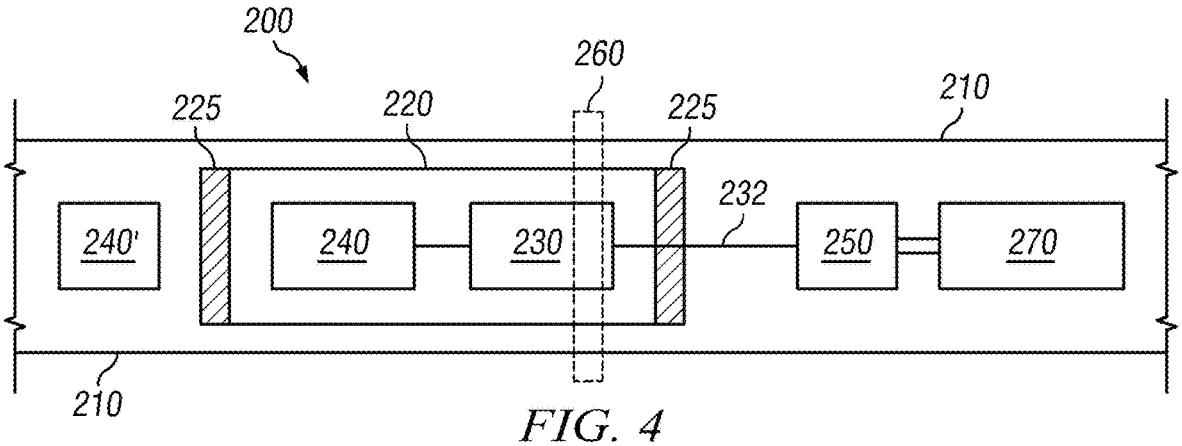
FIG. 4 depicts an example rotary steerable system including a roll-isolated housing deployed in a drill collar and a plurality of digital valves deployed in and rotationally coupled with the collar.

FIG. 4 depicts one example embodiment of a disclosed rotary steerable system 200 including a roll-isolated housing 220 deployed in a drill collar 210 and a plurality of digital valves 250 deployed in and rotationally coupled with the collar 210. In the depicted example embodiment, the roll-isolated housing 220 is rotationally isolated from the drill collar 210, but the angular extent of the rotation isolation is limited (e.g., the isolation may be limited to a fixed angle such as up to +/−3 degrees, up to +/−5 degrees, or up to +/−10 degrees, up to +/−20 degrees, or up to +/−30 degrees). The roll-isolated housing 220 may be coupled (e.g., mounted) to the collar 210 using rotary and/or axial couplings 225 that are intended to dampen high frequency torsional vibrations while allowing low frequency rotation of the housing 220 with the collar 210. For example, the roll-isolated housing 220 may have an average rotation rate that is essentially equal to the rotation rate of the drill collar 210, but may have an instantaneous or differential rotation rate that differs (sometimes significantly) from that of the drill collar 210. Such a configuration may advantageously isolate the housing 220 (and control unit 230) from damaging torsional dynamics.

In example embodiments the rotary and/or axial couplings 225 may include hanger bearings with a spring dampening assembly or an elastomeric coupling that attenuates high frequency rotation. In example embodiments in which such hanger bearings permit axial translation (e.g., axial sliding), the couplings 225 may further include a spring/damper coupling configured to isolate the roll-isolated housing 220 from axial vibrations. In such embodiments the coupling 225 may float axially with respect to the collar 210 or may include a telescopic linkage that provides the axial isolation from the collar 210.

The roll-isolated housing 220 may include a control unit 230 deployed therein and rotationally coupled therewith. As described above with respect to FIG. 2, the control unit may include numerous sensors, for example, including accelerometers, gyroscopic sensors, natural gamma ray sensors, temperature sensors, pressure sensors, and the like. The control unit may further include one or more processors configured to execute processor-readable program code embodying logic and including instructions for operating the RSS. The control unit may further include electronic memory. Such control units are well known in rotary steerable systems. The disclosed embodiments are, of course, not limited to the use of or the configuration of any particular control unit hardware, firmware, and/or software.

With continued reference to FIG. 4, RSS 200 further includes a plurality of digital valves (shown schematically and collectively at 250) deployed in and rotationally coupled with the drill collar 210. As such, the digital valves 250 may be referred to as being strapped down to the drill collar 210. As described above, the plurality of digital valves 250 may be in fluid communication with a corresponding plurality of pads (shown schematically and collectively at 270 in FIG. 4) that are configured to extend outward from the collar 210 into engagement with a wellbore wall and thereby steer the direction of drilling. In advantageous embodiments, the digital valves include bistable valves (e.g., as described above with respect to FIG. 2) that may be actuated (switched from one position to another) via a communication signal such as an electronic signal. The control 230 unit may be configured to provide such a communication signal, for example, via a hardwired connection 232 (or connections) between the control unit and the digital valves 250. In example embodiments, the hardwired connection may be routed, for example, along a rotary spring in the coupling 225. The control 230 unit may alternatively be connected to the digital valves 250 via a slip ring connection.

The RSS 200 may further include a turbine alternator 240, 240' deployed in the roll-stabilized housing 220 and/or in the drill collar 210. The turbine alternator 240, 240' may be configured to generate and provide power to various electrically powered components in the housing 220 and control unit 230. The disclosed embodiments are not limited to any particular configuration of turbine alternator 240, 240'. In embodiments in which the turbine alternator is deployed in the roll-stabilized housing 220 (e.g., as depicted at 240), it will be appreciated that the electrical power draw may twist the coupling 225 to some extent (e.g., by providing a rotational drag force to the housing 220). In alternative embodiments, the turbine alternator may be deployed in and rotationally coupled with the collar 210 (as depicted at 240'). In such embodiments, electrical power may be provided to the components in the housing 220 via a hardwired connection, for example, along a rotary spring in the coupling 225 or via a slip ring connection.

RSS 200 may optionally further include an angle sensor 260 configured to measure the angular orientation between the housing 220 and the collar 210. The sensor 260 may include, for example, a plurality of magnets deployed on the drill collar 210 and one or more corresponding cross-axial magnetic field sensor deployed in the roll isolated housing 220. The relative rotational orientation of the housing 220 with respect to the collar 210 may be determined from the cross-axial direction of the measured magnetic field. It will be appreciated that the disclosed embodiments do not require the use of such an angle sensor. For example, when the extent of rotation isolation is limited (e.g., to less than +/−5 degrees) it may be assumed that the housing 220 and collar 210 are approximately rotationally aligned. Misalignment errors may be ignored in such embodiments.

Figure 5:
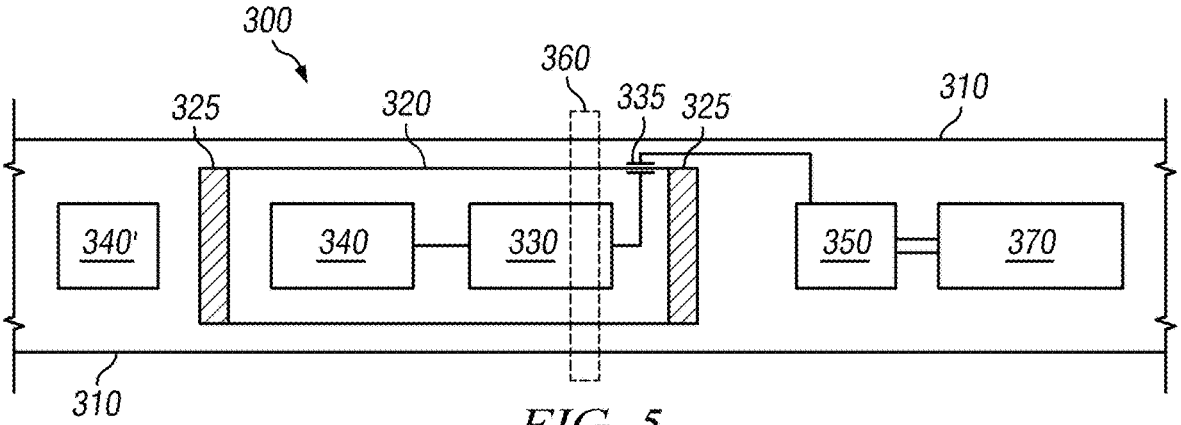
FIG. 5 depicts another example rotary steerable system including a roll-isolated housing deployed in a drill collar and a plurality of digital valves deployed in and rotationally coupled with the collar.

FIG. 5 depicts another example embodiment of a disclosed rotary steerable system 300 including a roll-isolated housing 320 deployed in a drill collar 310. RSS 300 is similar to RSS 100 in that digital valves 350 are deployed in and rotationally coupled with the drill collar 310. As described above, the digital valves 350 may be in fluid communication with a corresponding plurality of pads (shown schematically at 370 in FIG. 5) that are configured to extend outward from the collar 310 into engagement with a wellbore wall and thereby steer the direction of drilling. In the depicted example embodiment, the roll-isolated housing 320 is rotationally isolated from the drill collar 310, however, unlike in RSS 200, the extent of the relative rotation between the housing 320 and the collar 310 is not angularly limited (i.e., is not limited to any particular maximum angle difference). In other words, by not angularly limited it is meant that the housing 320 may rotate to any rotational orientation with respect to the collar 310.

RSS 300 further includes friction couplings 325 deployed between the housing 320 and the collar 310. The friction couplings 325 may be configured, for example, to slip above a predetermined torque threshold (or angular acceleration) such that the collar 310 may rotate with respect to the housing 320 (or thought of another way the housing 320 may rotate with respect to the collar 310). As stated above, the housing 320 and collar 310 may rotate to any relative rotational orientation with respect to one another. It will be appreciated that the use of a friction coupling may advantageously rotationally isolate the housing 320 from angular accelerations of the drill collar 310 (e.g., owing to stick slip, high frequency torsional oscillations, or other torsional dynamics) while generally allowing the housing 320 rotate with the drill collar 310. As such, the housing 320 may be rotationally independent from the collar 310 at high frequencies and rotationally coupled to the collar 310 at low frequencies.

With continued reference to FIG. 5, RSS 300 may include an electronic control unit, for example, as described above with respect to FIGS. 2 and 3. The control unit 330 may be in electrical and/or electronic communication with the digital valves via one or more slip rings 335 deployed on the housing 320 and collar 310. RSS 300 may further include an angle sensor 360 configured to measure the angular orientation between the housing 320 and the collar 310. The sensor 360 may include, for example, a plurality of magnets deployed on the drill collar 310 and one or more corresponding cross-axial magnetic field sensors deployed in the roll isolated housing 310 as described above with respect to FIG. 4.

As depicted, example RSS 300 may further include a turbine alternator 340, 340' deployed in the roll-stabilized housing 320 and/or in the drill collar 310. The turbine alternator 340, 340' may be configured to generate and provide power to various electrically powered components in the housing 320 and control unit 330. The disclosed embodiments are not limited to any particular configuration of turbine alternator 340, 340'. In embodiments in which the turbine alternator is deployed in the roll-stabilized housing 320 (e.g., as depicted at 340), it will be appreciated that the electrical power draw cause relative rotation between the housing 320 and the collar 310 (e.g., by providing a rotational drag force to the housing 320). In alternative embodiments, the turbine alternator may be deployed in and rotationally coupled with the collar 310 (as depicted at 340'). In such embodiments, electrical power may be provided to the components in the housing 320 via a slip ring connection.

It will be appreciated that in embodiments in which the turbine alternator 340 is deployed on the roll-isolated housing 320, reactive torque on the housing may cause the housing to rotate. Such rotation may be mitigated, for example, via the friction couplings 325 to provide a controlled rotation. RSS 300 may further include a fixed fin (not shown) that provides oppositely directed reaction torque to control housing rotation. Moreover, it will be further appreciated that the disclosed embodiments may include first and second turbine alternators 340, 340' (e.g., as described above with respect to FIG. 3) with oppositely directed reaction torque to control housing rotation. The disclosed embodiments are not limited in these regards. Moreover, it will be appreciated that the roll-isolation of housing 320 via turbine alternators 340, 340' be similarly applied to housing 420 using turbine alternators 440, 440' (FIG. 6)

Figure 6:
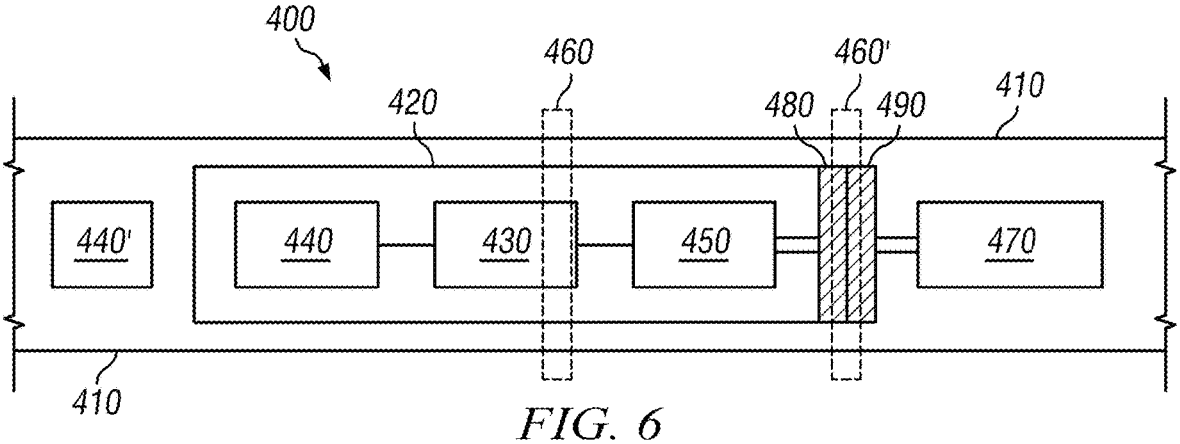
FIG. 6 depicts an example rotary steerable system including a roll-isolated housing deployed in a drill collar and a plurality of digital valves deployed in the roll-isolated housing.

FIG. 6 depicts still another example embodiment of a disclosed rotary steerable system 400 including a roll-isolated housing 420 deployed in a drill collar 410. RSS 400 differs from RSS 200 and RSS 300 in that the digital valves 450 are deployed in and rotationally coupled with the roll-isolated housing 420 rather than in the collar 410 (as depicted on FIGS. 4 and 5). As described above with respect to FIGS. 2, 4, and 5, the pads 470 are configured to extend outward from the collar 410 into engagement with a wellbore wall when actuated and thereby steer the direction of drilling.

As described in more detail below the digital valves 450 may be in fluid communication with the corresponding pads 470 via rotary couplings 480, 490 (e.g., rotary friction couplings) that are configured to provide fluid communication between each of the digital valves 450 and corresponding ones of the pads 470 independent of the relative rotation angle between housing 420 and the collar 410 (such that the digital valves may be in fluid communication with the pads regardless of the relative angle between the housing and collar). In the depicted example embodiment, the first rotary coupling 480 is deployed on and rotationally coupled with the roll-isolated housing 420 and the second rotary coupling 490 is deployed on and rotationally coupled with the collar 410. Moreover, in the depicted example embodiment, the first and second rotary couplings 480, 490 are deployed in contact with one another and are configured to provide rotationally independent flow paths between the housing 420 and collar 410. Example rotary couplings 480, 490 are described in more detail below with respect to FIGS. 7A and 7B.

As further depicted on FIG. 6, the roll-isolated housing 420 includes a control unit 430 deployed therein and rotationally coupled therewith. As described above with respect to FIG. 2, the control unit may include numerous sensors, for example, including accelerometers, gyroscopic sensors, natural gamma ray sensors, temperature sensors, pressure sensors, and the like as well as a processing unit including a processor, processor-readable program code, and memory. The disclosed embodiments are, of course, not limited to the use of or the configuration of any particular control unit hardware, firmware, and/or software. RSS 400 may further include turbine alternators 440, 440' deployed in the roll-stabilized housing 420 and/or collar 410 and configured to generate and provide power to various electrically powered components in the housing 420 and control unit 430. The disclosed embodiments are not limited to any particular configuration of turbine alternators 440, 440'.

Figure 7A:
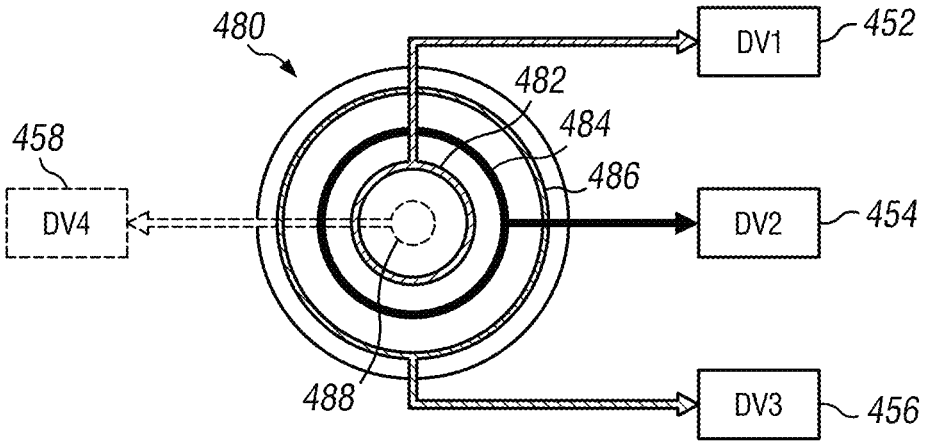
FIGS. 7A and 7B depict example concentric ring valve face seals (a rotary coupling) that provide fluid communication between digital valves deployed in the housing and corresponding pads deployed in the collar of the example RSS depicted on FIG. 6.
Figure 7B:
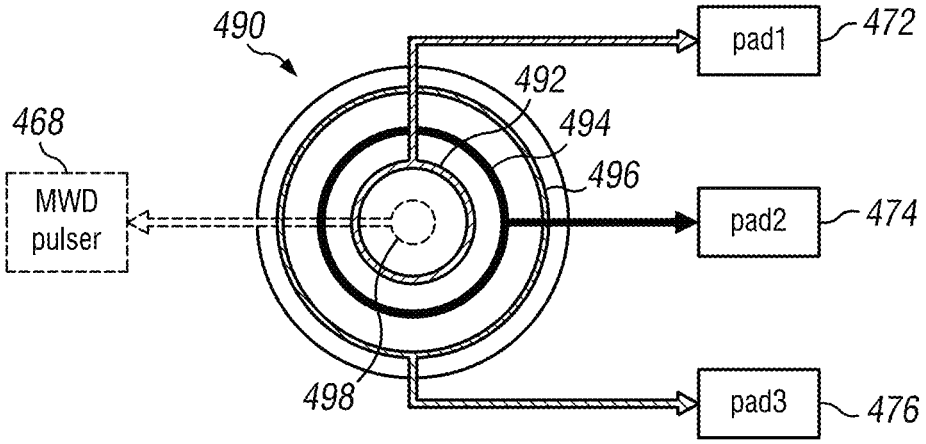

Turning now to FIGS. 7A and 7B, in example embodiments the rotary coupling may include first and second concentric ring valve face seals 480, 490 that include concentric ring shaped (or circular) flow channels that provide for fluid communication between the digital valves deployed in the housing 420 and the corresponding pads 450 deployed in the collar 410. For example, each of the face seals 480, 490 may include first 482, 492, second 484, 494, and third 486, 496 ring shaped flow channels corresponding to the first, second, and third digital valves. In the depicted example embodiment, the ring shaped flow channels extend through the thickness of the face seals 480, 490 (in the axial direction). As further depicted, the first, second, and third ring shaped flow channels 482, 484, 486 on the first ring shaped face seal 480 may be in fluid communication with corresponding first, second, and third digital valves 452, 454, 456. Likewise, first, second, and third ring shaped flow channels 492, 494, 496 on the second ring shaped face seal 490 may be in fluid communication with corresponding first, second, and third pads 472, 474, 476. While the disclosed embodiments are not limited in this regard, example embodiments of RSS tool 400 may further include a fourth digital valve 458 in fluid communication with a mud pulser deployed 468 in the collar 410. Such fluid communication may be provided via a fourth ring shaped groove or a central port 488, 498 as depicted in this example.

It will be appreciated that the rotary steerable tools often experience severe shock and vibration while flexing (bending) during routine drilling operations. To accommodate such routine operational conditions, the face seals 480, 490 may be slightly concave or convex (dish shaped) to accommodate such flexing. While the disclosed embodiments are not limited in this regard, the use of concave or convex face seals 480, 490 may enable the face seals to laterally flex without breaking the fluid seal or jamming during routine shock and vibration. The disclosed embodiments are, of course, not limited in these regards.

With reference again to FIG. 6, it will be appreciated that the disclosed rotary couplings 480, 490 are not limited to the above described concentric ring valve face seals 480, 490. In alternative embodiments, the rotary couplings 480, 490 may include, for example, a concentric barrel valve arrangement including first and second concentric tubes in which each of the concentric tubes has a plurality of flow channels that provide individual flow paths to each of the pads 470. In another alternative embodiment the rotary couplings 480, 490, may include, for example, a concentric cone valve arrangement including first and second concentric cones in which each of the concentric cones has a plurality of flow channels that provide individual flow paths to each of the pads 470.

With still further reference to FIG. 6, it will be appreciated that RSS 400 may further include an angle sensor 460 configured to measure the angular orientation between the housing 420 and the collar 410. The sensor 460 may include, for example, a plurality of magnets deployed on the drill collar 410 and one or more corresponding cross-axial magnetic field sensors deployed in the roll isolated housing 420.

In example embodiments, angle sensor 460 may be replaced with angle sensor 460'. In angle sensor 460', the magnets may be deployed in the second face seal 490 and the magnetic field sensor may be deployed in the first face seal 480. Such a substitution may be advantageous in that it eliminates the magnets deployed in the collar 410 and therefore eliminates a source of stress concentration in the collar 410.

In example embodiments, roll-isolated housing 420 may be free to rotate with respect to the collar 410, for example, to substantially any angular orientation. For example, the relative angular orientation may be random (or not controlled) and the relative rotation rates influenced by the downhole drilling conditions (e.g., torque on bit, torsional dynamics, etc.) and friction between the rotary couplings 480, 490. In other example embodiments, the turbine alternator(s) 440, 440' may be configured to servo the rotation rate of the housing 420 such that the relative angular orientation or the relative rotation rates between the housing 420 and collar 410 may be selected. In example embodiments, the turbine alternator(s) 440, 440' may be configured to enable relative slow rotation of the housing 420 (e.g., in a range from about 1 rpm to about 10 rpm with respect to the wellbore reference frame) allowing for continuous sensor calibration and azimuthal gamma measurements. The disclosed embodiments are, of course, not limited in these regards.

It will be appreciated that deployment of the digital valves 450 in the roll-isolated housing 420 may confer various advantages. For example, deployment of the valves 450 in the housing 420 tends to reduce exposure to shock and vibration and may therefore improve the service life of the digital valves 450. Moreover, deployment of the valves 450 in the housing 420 obviates the need for electrical connections between the control unit 430 and the collar 410. Such deployment may therefore improve reliability and improve electrical/electronic communication between the control unit 430 and the digital valves 450. Such improved communication may provide for improved diagnostics and error detection thereby enabling rapid response (e.g., changing a valve energization scheme in the event of a seal failure).

With further reference to FIGS. 2 and 4-6, it will be appreciated that pads (blades) 170, 270, 370, 470 may optionally further include one or more cutting elements deployed on an outer radial surface (or surfaces) of one or more of the pads. In such embodiments, extension of the pads (via digital valves 150, 250, 350, 450) may induce a cutting action on an inner wall of the wellbore and therefore enlarge the wellbore diameter or change the shape of the wellbore (in addition to steering the direction of drilling). Example cutting elements and corresponding pad (blade) configurations are disclosed in U.S. patent Ser. No. 10/837,234B2. It will be appreciated that the utilization of such cutting elements is purely optional.

Figure 8:
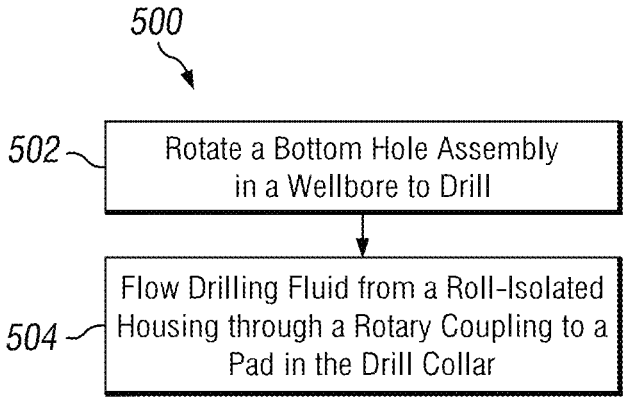
FIG. 8 depicts a flow chart of an example method for directional drilling.

FIG. 8 depicts a flow chart of an example method 500 for directional drilling. The method includes rotating a bottom hole assembly in a wellbore to drill at 502 and flowing drilling fluid from a roll-isolated housing through a rotary coupling to a pad to extend the pad and steer a direction of drilling at 504. As described above with respect to FIG. 6, the bottom hole assembly may include a rotary steerable system in which digital valves are deployed in the roll-isolated housing and in fluid communication with corresponding pads deployed in a drill collar. As also described above, opening the digital valve may be triggered or initiated by an electronic signal transmitted from a controller or processor also located in the roll-isolated housing. The method may further include closing the digital valve to break the fluid communication (flow) with the pad thereby enabling the pad to retract. It will be appreciated, based on the foregoing disclosure, that the opening may include independently opening individual ones of a plurality of digital valves in the roll-isolated housing to cause the high pressure drilling fluid to flow from the roll-isolated housing through corresponding distinct flow channels in the rotary coupling to corresponding ones of the plurality of extendable pads to thereby extend the corresponding pads.

Although roll isolated rotary steerable systems employing digital valves have been described in detail, it should be understood that various changes, substitutions and alternations can be made herein without departing from the spirit and scope of the disclosure as defined by the appended claims.

The invention claimed is:

1. A rotary steerable system comprising:

a drill collar;

a plurality of extendable pads deployed in and circumferentially about the drill collar, each of the plurality of pads configured to extend radially outward from the drill collar and engage a wellbore wall, said engagement operative to steer a direction of drilling;

a plurality of digital valves, each of the plurality of digital valves in fluid communication with a corresponding one of the plurality of extendable pads, wherein opening one of the plurality of digital valves provides high pressure drilling fluid to the corresponding one of the plurality of pads thereby radially extending the pad and closing the valve disconnects the pad from the pressurized drilling fluid thereby enabling the pad to retract;

a roll-isolated housing deployed in the drill collar; and an electronic control unit deployed in the roll-isolated housing, the electronic control unit including a plurality of electronic sensors and a processing unit configured to independently open and close each of the plurality of digital valves via a communications signal, wherein each of the plurality of digital valves is deployed in the drill collar, wherein the roll-isolated housing is coupled to the drill collar using a friction coupling that is configured to slip above a predetermined torque threshold such that the roll-isolated housing and the drill collar may rotate with respect to one another, and wherein the electronic control unit is electrically coupled with each of the digital valves via a slip ring connection between the roll isolated housing and the drill collar.

2. The rotary steerable system of claim 1, wherein:

the roll-isolated housing is coupled to the drill collar using a rotation limited coupling that limits rotational isolation between the roll-isolated housing and the drill collar to +/−30 degrees or less.

3. The rotary steerable system of claim 1, further comprising a turbine alternator deployed in the roll-isolated housing, the turbine alternator configured to provide electrical power to the control unit and to control a relative rotation rate or a relative angular position between the roll-isolated housing and the drill collar.

4. A rotary steerable system comprising:

a drill collar;

a plurality of extendable pads deployed in and circumferentially about the drill collar, each of the plurality of pads configured to extend radially outward from the drill collar and engage a wellbore wall, said engagement operative to steer a direction of drilling;

a roll-isolated housing deployed in the drill collar;

a plurality of digital valves deployed in and rotationally coupled with the roll-isolated housing, each of the plurality of digital valves in fluid communication with a corresponding one of the plurality of extendable pads through a rotary coupling that is configured to provide the fluid communication independent of a relative rotation angle between roll-isolated housing and the drill collar, wherein opening one of the plurality of digital valves provides high pressure drilling fluid to the corresponding one of the plurality of pads thereby radially extending the pad and closing the valve disconnects the pad from the pressurized drilling fluid thereby enabling the pad to retract; and an electronic control unit deployed in the roll-isolated housing, the electronic control unit including a plurality of electronic sensors and a processing unit configured to independently open and close each of the plurality of digital valves via a communications signal, wherein the rotary coupling comprises a plurality of flow channels sized and shaped to provide individual flow paths between each of the plurality of digital valves deployed in the roll-isolated housing and the corresponding one of the plurality of pads.

5. The rotary steerable system of claim 4, wherein:

the rotary coupling comprises first and second rotary friction couplings that contact one another;

the first rotary friction coupling is rotationally coupled with the roll-isolated housing; and the second rotary friction coupling is rotationally coupled with the drill collar.

6. The rotary steerable system of claim 5, wherein:

the plurality of flow channels comprises a first plurality of circular flow channels and a second plurality of circular flow channels;

the first rotary friction coupling comprises the first plurality of circular flow channels;

the second rotary friction coupling comprises the second plurality of circular flow channels;

and the fluid communication between individual ones of the plurality of digital valves and the plurality of extendable pads is provided via corresponding ones of the first plurality of circular flow channels and the second plurality of circular flow channels.

7. The rotary steerable system of claim 5, further comprising an angle sensor configured to measure a rotational angle between the roll-isolated housing and the drill collar, the angle sensor including at least first and second magnets deployed in the second rotary friction coupling and a magnetic field sensor deployed in the first rotary friction coupling.

8. The rotary steerable system of claim 4, further comprising a turbine alternator deployed in the roll-isolated housing, the turbine alternator configured to provide electrical power to the control unit and to control a relative rotation rate or a relative angular position between the roll-isolated housing and the drill collar.

9. A method for direction drilling, the method comprising:

rotating a bottom hole assembly in a wellbore to drill a wellbore, the bottom hole assembly including a rotary steerable system and a drill bit, the rotary steerable system including a plurality of extendable pads deployed in a drill collar and an electronic controller deployed in a roll-isolated housing in the drill collar; and opening a digital valve in the roll-isolated housing to cause high pressure drilling fluid to flow from the roll-isolated housing through a rotary coupling located between the roll-isolated housing and the drill collar to one of the plurality of extendable pads to thereby extend the extendable pad and steer the drilling of the wellbore, wherein the opening comprises independently opening individual ones of a plurality of digital valves in the roll-isolated housing to cause the high pressure drilling fluid to flow from the roll-isolated housing through corresponding distinct flow channels in the rotary coupling to corresponding ones of the plurality of extendable pads to thereby extend the corresponding pads.

10. The method of claim 9, wherein the opening is initiated by transmitting an electronic signal from the electronic controller to the digital valve in the in the roll-isolated housing.

11. The method of claim 9, further comprising closing the digital valve in the roll-isolated housing to disconnect the flow of high pressure drilling fluid and thereby enable the extendable pad to retract.

* * * * *